United States Patent [19]

Tittgemeyer et al.

[11] Patent Number: 4,798,136

[45] Date of Patent: Jan. 17, 1989

[54] COLOR PRINTING METHOD AND ARRANGEMENT

[75] Inventors: Udo Tittgemeyer; Thomas Litterst, both of Arnsberg, Fed. Rep. of Germany

[73] Assignee: Interprint Rotatinsdruk GmbH & Co. KG, Arnsberg, Fed. Rep. of Germany

[21] Appl. No.: 927,885

[22] Filed: Nov. 5, 1986

Related U.S. Application Data

[63] Continuation-in-part of Ser. No. 485,633, Apr. 18, 1983.

[30] Foreign Application Priority Data

Apr. 16, 1982 [DE] Fed. Rep. of Germany ..... 3214001

[51] Int. Cl.[4] ..... B41F 5/06; B41F 23/00; B41F 13/02

[52] U.S. Cl. ..... 101/181; 101/426

[58] Field of Search ..... 101/181, 248, 416 R, 101/416 A, 228; 250/548, 561, 571, 559; 226/2, 3, 15, 20, 27, 46; 34/46; 356/429

[56] References Cited

U.S. PATENT DOCUMENTS

| | | | |
|---|---|---|---|
| 2,306,607 | 12/1942 | Horton | 101/416 A |
| 2,359,825 | 10/1944 | Campbell | 101/416 R |
| 2,549,605 | 4/1951 | Huck | 101/181 |
| 2,674,809 | 4/1954 | Meienhofer | 101/416 A |
| 3,432,672 | 3/1969 | Bessonny et al. | 101/181 X |
| 3,570,735 | 3/1971 | Kurz | 226/3 |
| 4,233,901 | 11/1980 | Mallinson | 101/416 A |

FOREIGN PATENT DOCUMENTS

| | | | |
|---|---|---|---|
| 637136 | 5/1950 | United Kingdom | 101/416 A |

*Primary Examiner*—J. Reed Fisher
*Attorney, Agent, or Firm*—Peter K. Kontler

[57] ABSTRACT

A color printing arrangement has a series of printing stations in each of which a different color is imprinted upon predetermined regions of a travelling band to form color images. A device for measuring the width of the band by sensing the edges thereof is located immediately upstream of each printing station. The width of the band at the first printing station is compared with the width at each of the following printing stations. As long as the widths at the latter printing stations are the same as that at the first printing station, the band is allowed to continue travelling unchanged. However, when the width of the band at a printing station downstream of the first printing station differs from the width at the first printing station, the band is operated upon to return the width to its original value. The reason is that a departure from the original width of the band causes the predetermined regions which are to be imprinted to be moved out of alignment with the printing devices in the printing stations. By returning the width to its original value, the alignment of the predetermined regions is restored.

25 Claims, 3 Drawing Sheets

COLOR PRINTING METHOD AND ARRANGEMENT

CROSS-REFERENCE TO RELATED APPLICATION

This application is a continuation-in-part of application Ser. No. 485,633 filed Apr. 18, 1983 now abandoned.

BACKGROUND OF THE INVENTION

The invention relates to a printing method and arrangement.

More particularly, the invention relates to a color printing method and arrangement, especially a method of and an arrangement for imprinting an image carrier with two or more colors which are superimposed in order to produce colors representing mixtures of the original colors.

A known arrangement for imprinting an image carrier with two or more superimposed colors has a plurality of printing stations. Each of the printing stations has a printing drum or a register which applies a different color to the image carrier. In order for the colors to be superimposed, the image carrier must have a predetermined orientation or alignment relative to each of the printing drums. To this end, a regulating mechanism is provided to ensure proper alignment of the image carrier relative to the drums.

One procedure employed for proper relative alignment of the image carrier and a drum is the so-called longitudinal alignment procedure. In this procedure, a first series of marks is formed on the image carrier by a first printing device while a second series of corresponding marks is formed on the image carrier by a second printing device. The respective series of marks lie on scanning lines which are located close to one another. Each of the scanning lines is continuously illuminated by a small light source. The light reflected from the image carrier along each of the scanning lines travels to a respective photocell. When a mark passes by a light source, the intensity of the reflected light changes. The corresponding photocell transforms the intensity change into an electrical pulse. The pulse is amplified in an electronic device in order to convert it into a form which is suitable for measuring purposes as well as for the performance of regulating functions.

The electronic device receives a separate pulse for each of two corresponding marks on the two scanning lines. The time difference between arrival of the pulses at the output of the electronic device regulates an electric current having a magnitude which depends upon the magnitude of the time difference. If, for example, two corresponding marks are widely spaced as considered in a direction along the scanning lines, the time difference between the pulses is large and the current due to this time difference is also large. The current controls an alignment motor which is arranged to move a printing drum mounted in the printing arrangement for the image carrier. The amount of movement of the printing drum depends upon the time difference between the pulses. For instance, if the time difference is large, the drum is moved by a large amount. It is possible to design the alignment motor so that it operates in forward or reverse depending upon which of two corresponding marks is detected first.

Another procedure for aligning the image carrier relative to a printing drum is the so-called lateral alignment procedure. This procedure is used for lateral alignment of the image carrier relative to the printing drum. In the lateral alignment procedure, a series of marks is imprinted on the image carrier along a line which is inclined to the direction of travel or the longitudinal direction of the image carrier. Normally, such line is inclined at an angle of 45° to the direction of travel of the image carrier.

The marks for the longitudinal alignment procedure, that is, the marks which are used to align the image carrier along its longitudinal direction, may be provided in addition to those for the lateral alignment procedure. Since the scanning lines defined by the marks for the longitudinal alignment procedure extend longitudinally of the image carrier, the line defined by the marks for the lateral alignment procedure is inclined with respect to these scanning lines.

When marks for both the longitudinal and lateral alignment procedures are present, a correspondence may exist between each mark for the lateral alignment procedure and each pair of marks for the longitudinal alignment procedure. By means of an appropriate electronic circuit, two electrical pulses are generated for each set of marks consisting of a lateral alignment mark and a pair of longitudinal alignment marks. One such pulse serves to regulate longitudinal alignment of the image carrier relative to a printing drum while the other pulse serves to regulate lateral alignment of the image carrier relative to the drum. The image carrier and the printing drum are aligned relative to one another longitudinally of the image carrier in the manner described above. On the other hand, relative lateral alignment of the image carrier and the drum is effected via an alignment motor which is connected to a paper roller. This roller guides the image carrier to one side or the other.

The preceding procedures for relative alignment of an image carrier and a printing drum have certain disadvantages. To begin with, the marks must be properly positioned relative to the image or images at the same time that the carrier is produced. This, however, can be accomplished with relatively good precision only by skilled workers. Furthermore, the use of marks is based on the assumption that the positions of the marks relative to the image or images remain the same so that alignment of the marks results in proper alignment of the image carrier relative to a printing drum. This assumption ignores the fact that deformation of the image carrier is non-uniform, e.g. an area with an image may deform differently than an area with no image. Thus, in practice, the differing characteristics of an image carrier cannot be taken into account by marks. Even if the marks are precisely aligned relative to a printing drum, there is no assurance the the region of the image carrier to be imprinted is aligned in the same manner.

Anothe drawback of the alignment procedures described earlier resides in that the image carrier is only indirectly affected by the alignment operations. For example, in the longitudinal alignment procedure, the position of a printing drum is adjusted so as to conform to the orientation of the image carrier. In the lateral alignment procedure, on the other hand, one or more paper rollers are adjusted in such a manner as to guide the image carrier beneath a printing drum in the desired position. Since the image carrier is not acted on directly, it is uncertain whether the image carrier retains the position it has prior to adjustment of the printing roller or the paper roller. Depending upon the elastic properties of the image carrier, it is possible for the latter to deform in an undesired manner even when it is stressed, e.g. by a paper roller, so that uncontrolled deformation would not be expected. By way of example, a possible result of unexpected deformation is that the different colors applied by different printing drums are imprinted next to one another rather than one over the other as desired. The different colors then do not combine to form a new color representing a mixture of the different colors and the image instead contains a set of discrete lines which are arranged next to one another and have various colors.

The preceding description of the drawbacks arising from the use of marks to align an image carrier and a printing drum relative to one another indicates that the marks are useful in achieving alignment of the various printing drums of a printing arrangement with respect to each other. On the other hand, it is likewise clear that the marks are not suitable as an aid in obtaining proper relative alignment of an image and a printing drum.

In certain conventional printing arrangements, the intervals at which consecutive marks along a row pass by a photocell are measured. Depending on the lengths of the intervals, the positions of selected components of such a printing arrangement are changed in such a manner as to permit adjustment of the position of the image carrier which may, for instance, be constituted by a paper band.

In a printing arrangement of this type, the intervals between consecutive marks may be precisely determined. By regulating appropriate components of the printing arrangement in dependence upon the measured intervals, the intervals between consecutive marks are maintained substantially constant.

Since a constant interval between consecutive marks is not critical to obtaining proper relative alignment of an image carrier and a printing drum, the equipment for maintaining the intervals between consecutive marks constant increases the complexity and cost of the printing arrangement unnecessarily.

OBJECTS AND SUMMARY OF THE INVENTION

It is an object of the invention to provide a printing method and arrangement which enable an image carrier and a printing device to be properly aligned relative to one another in a simpler manner than heretofore.

Another object of the invention is to provide a printing method and arrangement which enable an image carrier and a printing device to be properly oriented relative to one another without imprinting special marks on the image carrier.

An additional object of the invention is to provide a printing method and arrangement which enable an image carrier and a printing device to be properly aligned relative to one another even though the image carrier may undergo non-uniform deformation.

A further object of the invention is to provide a printing method and arrangement which enable an image carrier and a printing device to be properly aligned relative to one another by operating upon the image carrier directly.

It is also an object of the invention to provide a color printing method of the type described above which enables the different colors applied to an image carrier to be superimposed with one another.

Still another object of the invention is to provide a color printing arrangement which is equipped with a plurality of printing devices for applying different colors to an image carrier and which is provided with relatively simple and inexpensive means for adjusting the image carrier in such a manner that the various colors applied to the image carrier are superimposed with one another.

The preceding objects, as well as others which will become apparent as the description proceeds, are achieved by the invention.

One aspect of the invention resides in a printing method which comprises the following steps:

A. Conveying an image carrier along a predetermined path which extends through a first printing station, and a second printing station located downstream of the first station. The carrier has a pair of edges which are spaced transversely of the path.

B. Measuring the width of the carrier upstream of the first printing station by sensing the edges of the carrier.

C. Imprinting a predetermined region of the carrier in the first printing station.

D. Remeasuring the width of the carrier between the first and second printing stations by sensing the edges of the carrier.

E. Comparing the widths obtained during the measuring and remeasuring steps.

F. Adjusting the carrier when the widths obtained from the measuring and remeasuring steps differ significantly from one another. The adjusting step is performed in such a manner that the width obtained during the remeasuring step approaches that obtained during the measuring step.

G. Imprinting the predetermined region of the carrier in the second station.

A different color may be applied to the image carrier in each of the printing stations and these colors may be superimposed with one another to form a new color constituting a mixture of the original colors.

The method of the invention eliminates the conventional indirect regulation of the relative positions of an image carrier and a printing device via marks imprinted on the image carrier. By using the method of the invention, it becomes possible to maintain the overall dimensions of the image carrier essentially constant as the image carrier travels through the various printing stations. Since the width of the image carrier is representative of the entire image carrier, differential expansion and contraction of the image carrier no longer influence the orientation thereof.

The overall dimensions of the image carrier may be maintained substantially constant by keeping the width of the image carrier essentially constant. The operation or operations required to maintain the dimensions of the image carrier substantially constant are performed directly upon the image carrier. This makes it unnecessary to operate upon the image carrier indirectly by moving guide rollers and printing devices. Accordingly, the moving mechanisms previously required for shifting the guide rollers and printing devices may be eliminated and all that is needed are means for holding the rollers and drums in position. Direct operation upon the image carrier in order to maintain its form or dimensions substantially constant has the advantages that it may be performed in a relatively simple manner and is substantially independent of subjective influences such as, for example, those affecting the precision with which a mark is imprinted on an image carrier.

Another aspect of the invention resides in a printing arrangement which comprises the following elements:

A. Conveying means for conveying an image carrier along a predetermined path. The carrier has a pair of edges which are spaced transversely of the path.

B. A first printing station in a first portion of the path of the carrier.

C. First measuring means upstream of the first printing station for measuring the width of the carrier by sensing the edges thereof.

D. A second printing station in a second portion of the path of the carrier downstream of the first portion of the path.

E. Second measuring means between the first and second printing stations for remeasuring the width of the carrier by sensing the edges thereof.

F. Adjusting means for the carrier connected with the first and second measuring means. The adjusting means is designed to compare the widths obtained from the first and second measuring means and to adjust the carrier in such a manner when such widths differ significantly from one another that the width at the second measuring means approaches that at the first measuring means.

The first printing station may comprise a printing device for imprinting the image carrier with a first color while the second printing station may comprise a printing device for imprinting the image carrier with a different second color which is superimposed with the first color to form a new color constituting a mixture of the two original colors.

In the event that one or more printing stations additional to the second printing station are located downstream of the first printing station, an additional measuring means may be arranged upstream of each additional printing station. The adjusting means is then preferably designed to compare the values obtained from the first measuring means with the values obtained from each of the other measuring means.

The arrangement in accordance with the invention makes it possible to maintain the dimensions of the image carrier substantially constant by operating directly upon the image carrier. This makes it unnecessary to shift components of the printing arrangement in order to properly align the image carrier and a printing device relative to one another. Accordingly, the printing arrangement of the invention is flexible and is able to respond to control signals from the adjusting means rapidly and with relatively little inertia. The control signals cause the image carrier to be directly subjected to a specified operation or specified operations which maintain the width of the image carrier substantially constant. The width is representative of the entire image carrier and, by keeping this essentially unchanged, the overall dimensions of the image carrier are maintained constant to such a degree that a contour or outline formed on the image carrier in a given color by one printing device is in position to be imprinted with a different color by a following printing device so as to obtain the desired color mixture.

The printing arrangement according to the invention is more economical and operates more rapidly and precisely than conventional printing arrangements.

The novel features which are considered as characteristic of the invention are set forth in particular in the appended claims. The improved printing arrangement itself, however, both as to its construction and its mode of operation, together with additional features and advantages thereof, will be best understood upon persual of the following detailed description of certain specific embodiments with reference to the accompanying drawings.

DESCRIPTION OF THE PREFERRED EMBODIMENTS

Figures 1, 2:
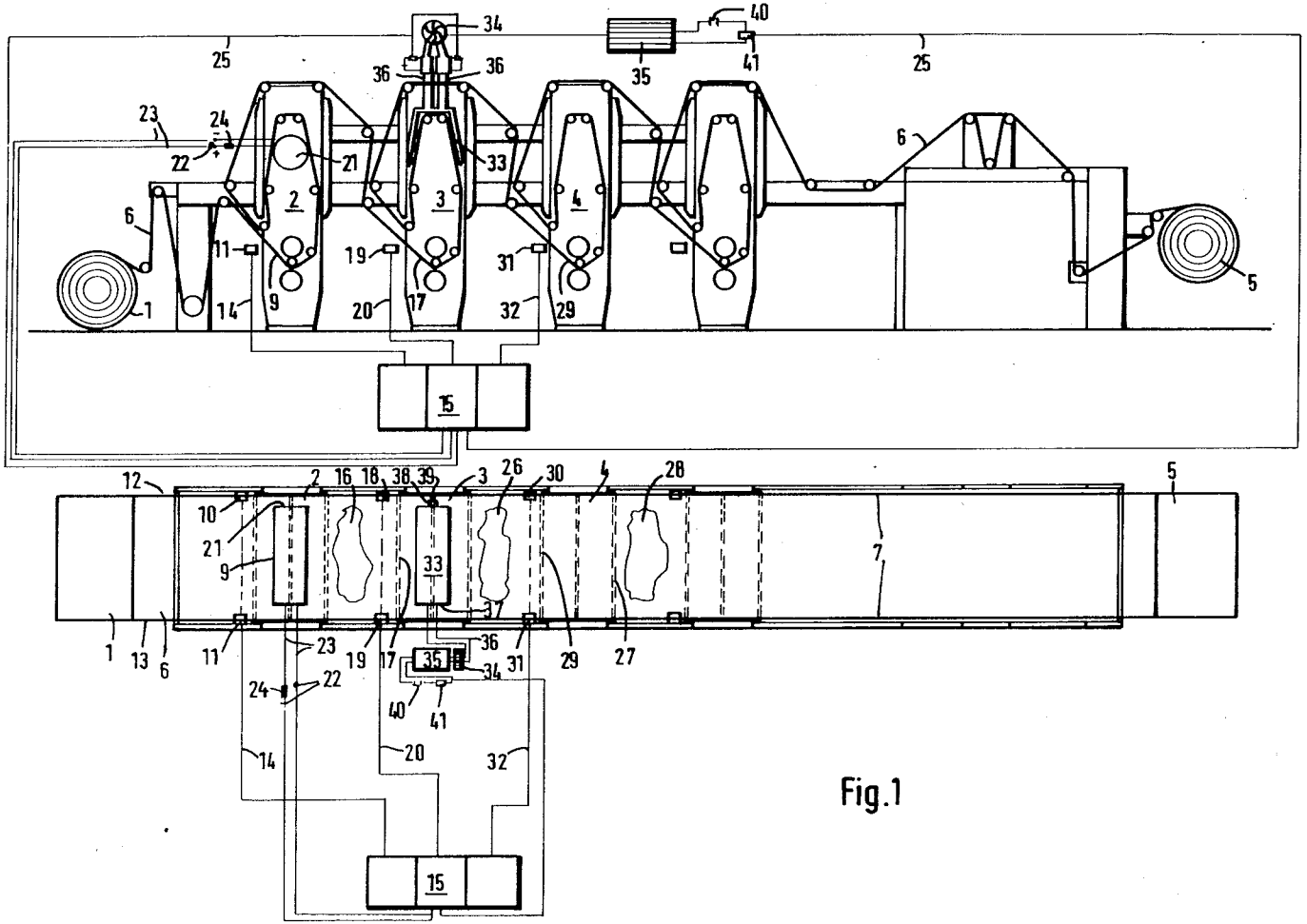
FIG. 1 is a schematic plan view of a printing arrangement in accordance with the invention.
FIG. 2 is a schematic side view of the printing arrangement of FIG. 1.

FIGS. 1 and 2 illustrate a printing arrangement according to the invention. The printing arrangement of FIGS. 1 and 2 is well-suited for performing the printing method of the invention.

The printing arrangement includes a series of printing stations 2, 3, 4. A roller 1, which may constitute a supply roller, is located at an upstream end of the printing arrangement whereas a takeup roller 5 is situated at a downstream end of the printing arrangement. An image carrier 6 in the form of a band is unwound from the supply roller 1 and is guided through the printing arrangement by a set of guide rollers. After passing through the printing arrangement, the band 6 is wound onto the takeup roller 5 for further processing. The band 6 sequentially passes through the printing stations 2, 3, 4 as it travels from the supply roller 1 to the takeup roller 5.

The band 6 may, for example, be in the form of a paper band.

The width of the band 6 is identified by the reference numeral 7. The width 7 constitutes a physical characteristic or parameter of the band 6 which is representative of the overall dimensions or degree of deformation of the band 6.

The printing station 2 has an inlet 9 which is located immediately upstream of the printing station 2. The width 7 of the band 6 is measured in the region of the inlet 9. To this end, a measuring device is arranged in the region of the inlet 9. The measuring device includes a pair of spaced detecting units 10 and 11 which are positioned to detect respective edges 12 and 13 of the band 6. The detecting units 10 and 11 may be adjustable relative to one another so that the measuring device 10, 11 can be set at least approximately to the expected magnitude of the width 7. It is possible to provide another measuring device immediately downstream of the supply roller 1 in order to measure the width 7 of the band 6 as the band 6 is unwound from the supply roller 1.

The detecting unit 10 which is arranged to detect the edge 12 of the band 6 generates a signal when it senses the presence of the edge 12. Similarly, the detecting unit 11 which is arranged to detect the edge 13 of the band 6 generates a signal when it senses the presence of the edge 13. The signals generated by the detecting units 10, 11 are delivered to a control unit 15 via a conductor 14. The control unit 15 processes the signals from the detecting units 10, 11 to arrive at the magnitude of the width 7.

In the printing station 2, the band 6 is imprinted with a first basic or primary color. This first basic color may constitute the final color for certain regions of the band 6. However, in one or more predetermined regions of the band 6, the first basic color is to be mixed with a second color supplied by the printing station 3 and/or with a third color supplied by the printing station 4. The mixing effect is achieved by applying the second and/or third colors to the band 6 in such a manner that these are superimposed upon the first color.

In the printing station 2, a contour or outline 16 is formed on the band 6. The contour 16 constitutes a predetermined region of the band 6 which is to be imprinted with the second color supplied by the printing station 3. When the contour 16 enters the printing station 3, the contour 16 must be oriented in such a manner that the second color is applied directly over the contour 16. This achieves the desired mixing of the first color forming the contour 16 with the second color of the printing station 3.

The precise relative alignment required of the contour 16 and the printing device in the printing station 3 for superimposition of the second color on the contour 16 is achieved by insuring that the dimensions of the band 6 upon entering the printing station 3 are the same as they were upon entering the printing station 2. If the dimensions at the printing station 3 are the same as those at the printing station 2, it may be assumed that the position or orientation of the contour 16 relative to the band 6 is exactly the same at the printing station 3 as it was at the printing station 2. Accordingly, if the printing device in the printing station 3 is appropriately aligned relative to the band 6, the printing device imprints the second color directly on the contour 16 formed in the printing station 2.

The printing station 3 has an inlet 17 which is situated immediately upstream of the printing station 3. In order that the dimensions of the band 6 at the printing station 3 may be the same as those at the printing station 2, a device for measuring the width 7 of the band 6 is located in the region of the inlet 17. The measuring device includes a pair of spaced detecting units 18 and 19 which are respectively arranged to detect the edges 12 and 13 of the band 6. The detecting units 18 and 19 may be movable relative to one another so that the measuring device 18, 19 may be adjusted to at least approximately the expected magnitude of the width 7.

The detecting units 18 and 19 generate signals when they detect the respective edges 12 and 13. These signals are delivered to the control unit 15 via a conductor 20. The control unit 15 processes the signals from the detecting units 18 and 19 to obtain the magnitude of the width 7.

The control unit 15 compares the magnitude of the width 7 at the inlet 17 of the printing station 3 with the magnitude of the width 7 at the inlet 9 of the printing station 2. If the magnitude of the width 7 at the inlet 9 and the inlet 17 are identical, the contour 16 is properly aligned to be imprinted by the printing device in the printing station 3. On the other hand, if the magnitude of the width 7 at the inlet 17 differs from the magnitude of the width 7 at the inlet 9, the control unit 15 calculates the difference between the magnitudes and generates a control pulse having a magnitude which is proportional to this difference.

The printing station 2 is provided with a heating device 21 in the form of a heated drum. The heating device 21 is here an electrical device and is connected with the control unit 15 via an electrical circuit 23. A circuit source 22 is located in the electrical circuit 23 as is a variable resistor 24 which may be used to regulate the heat given off by the heating device 21. The resistor 24 is adjusted in dependence upon the control pulses generated by the control unit 15.

The drum constituting the heating device 21 need not be electrically heated. Thus, the drum may, for example, be heated with hot gases, including water vapor, or hot water.

When the magnitude of the width 7 at the inlet 17 differs substantially from that at the inlet 9, it may be concluded that the band 6 has undergone substantial deformation along the portion of its path between the inlet 9 and the inlet 17. The band 6 is under a constant stress and deformation of the band 6 manifests itself by a change in the dimensions of the band 6. Assuming that expansion of the band 6 has occurred between the inlets 9 and 17, the dimensions of the band 6 at the inlet 17 may be returned to those at the inlet 9 by driving or removing moisture from the band 6. This may be accomplished by the heating device 21. The amount of heat supplied to the band 6 by the heating device 21 depends on the amount of moisture to be removed from the band 6 which, in turn, is related to the difference between the dimensions of the band 6 at the inlets 9 and 17. If the difference between the magnitudes of the width 7 at the inlets 9 and 17 is large, a large amount of moisture must be removed from the band 6 and the heating device 21 must supply a corresponding amount of heat to the band 6. If the difference between the magnitudes of the width 7 at the inlets 9 and 17 is small, only a small quantity of heat need be supplied to the band 6 in order to return the dimensions at the inlet 17 to those at the inlet 9. The shrinkage or contraction achieved by means of the heating device 21 may be very precisely controlled and it may be assumed that the magnitude of the width 7 at the inlet 17 returns to the value it had at the inlet 9.

In the printing station 3, the second color is applied to the contour 16. The second color may also be applied to regions of the band 6 outside of the contour 16. Certain regions of the band 6 achieve their final coloring in the printing station 3. Some of these regions are located within the contour 16 and have a color which corresponds to a mixture of the colors applied to the band 6 in the printing stations 2 and 3. Others of the regions which achieve their final coloring in the printing station 3 are located outside of the contour 16 and have the second color as their final color. The second color constitutes a basic or primary color in the latter regions.

A predetermined region of the band 6 shown as a contour or outline 26 is imprinted with the third color in the printing station 4. Upon leaving the printing station 4 via an outlet 27 of the latter, the band 6 has a multicolored image 28. The image 28 may have three basic or primary colors which are respectively constituted by the first, second and third colors of the printing stations 2, 3, 4. The image 28 may further have a color which represents a mixture of the first and second colors, a color which represents a mixture of the first and third colors and a color which represents a mixture of the second and third colors. Finally, the image 28 may have a color which represents a mixture of the first, second and third colors.

In order to obtain colors which represent a mixture of the first and/or second colors with the third color, it is necessary that the orientation or position of the contour 26 upon entering the printing station 4 be such that the printing device in the printing station 4 applies the third color directly over the contour 26. Accordingly, the orientation of the contour 26 upon entering the printing station 4 must be controlled as precisely as the orientation of the contour 16 upon entering the printing station 3.

The printing station 4 has an inlet 29 which is located immediately upstream of the printing station 4. A device for measuring the width 7 of the band 6 is located in the region of the inlet 29 and includes a pair of detecting units 30 and 31. The detecting units 30 and 31 are respectively arranged to detect the edges 12 and 13 of the band 6. The detecting units 30 and 31 are movable relative to one another so that the measuring device 30, 31 may be adjusted at least approximately to the expected magnitude of the width 7.

The measuring device 30, 31 is connected with the control unit 15 via a conductor 32. The detecting units 30 and 31 generate signals when they sense the presence of the respective edges 12 and 13 of the band 6, and the control unit 15 processes these signals to determine the magnitude of the width 7. The control unit 15 compares the magnitude of the width 7 as determined by the measuring device 10, 11 with the magnitude of the width 7 as determined by the measuring device 30, 31. If the magnitude of the width 7 at the inlet 29 is the same as that at the inlet 9, the orientation of the contour 26 relative to the printing device in the printing station 4 is such that the printing device applies the third color directly over the contour 26. This produces the desired mixing effect of the third color with the colors of the contour 26. On the other hand, if the magnitude of the width 7 at the inlet 29 differs from that at the inlet 9, the control unit 15 generates a control signal having a magnitude which is a function of the change in the width 7.

A drying chamber 33 is located in the path of the band 6 between the inlet 17 of the printing station 3 and the measuring device 30, 31. Air for drying or removing moisture from the band 6 is drawn through the chamber 33 by means of a fan or circulator 34 which is driven by a motor 35. The chamber 33 has an inlet or suction end 37 and the fan 34 communicates with the interior of the chamber 33 via a suction manifold 36 which opens into the chamber 33 at the suction end 37. The chamber 33 further has a pressure or inlet end 38 which is located opposite the suction end 37 and is provided with a pressure inlet element 39. The pressure inlet element 39 communicates with the atmosphere, and the fan 34 draws atmospheric air into the chamber 33 via the pressure inlet element 39. The air drawn into the chamber 33 travels from the pressure end 38 to the suction end 37 and, in the process, flows around and removes moisture from the band 6.

It is assumed here that the magnitude of the width 7 at the inlet 29 exceeds that at the inlet 9. The removal of moisture from the band 6 results in contraction of the latter and the amount of moisture removed from the band 6 is controlled in such a manner that the magnitude of the width 7 at the inlet 29 returns to the magnitude of the width 7 at the inlet 9.

The amount of moisture removed from the band 6, and hence the degree of contraction of the band 6, depends upon the amount of air drawn through the chamber 33 per unit of time. The quantity of air may be regulated by regulating the rotational speed of the fan 34. This may be accomplished by means of a separate regulating mechanism disposed between the motor 35 and the fan 34. Alternatively, the motor 35 may be constructed as a variable speed motor.

The motor 35 forms part of a circuit 25 which is connected with the control unit 15. The circuit 25 further includes a current source 40 for the motor 35 as well as a variable resistor 41. The current supplied to the motor 35, and accordingly the rotational speed of the fan 34, is controlled by the control signals which are generated by the control unit 15 in response to the signals from the measuring device 30, 31. The magnitudes of the control signals determine the settings of the resistor 41 which, in turn, determine the amount of current supplied to the motor 35.

A heating device is advantageously provided to heat the air drawn into the chamber 33 and this heating device may, for example, be located inside the chamber 33. The heating device may be connected with the control unit 15 via a circuit which permits the heat generated by the heating device, and hence the temperature of the drying air, to be regulated.

The operation of the printing arrangement according to the invention may be summarized as follows:

The band 6 is unwound from the supply roller 1. The width 7 of the band 6 is measured in the region of the inlet 9 of the printing station 2 by the measuring device 10, 11. In the printing station 2, the band 6 is imprinted with the contour 16.

The width 7 of the band 6 is measured in the region of the inlet 17 of the printing station 3 by the measuring device 18, 19. The magnitude of the width 7 at the inlet 17 is compared with that at the inlet 9 in the control unit 15. If the magnitudes are the same, the band 6 continues unchanged into the printing station 3. The contour 16 is imprinted in the printing station 3 and the band 6 leaves the printing station 3 with a new contour 26 which is to be imprinted in the printing station 4. On the other hand, if the magnitude of the width 7 at the inlet 17 exceeds that at the inlet 9, the band 6 is adjusted so that the magnitude of the width 7 at the inlet 17 is reduced to the magnitude of the width 7 at the inlet 9. This is accomplished by driving off moisture from the band 6 with the aid of the heating device 21 so that the band 6 contracts to the dimensions which it exhibits at the inlet 9. Contraction of the band 6 causes the contour 16 to be brought into a position of alignment with the printing device in the printing station 3 and thereby insures that the contour 16 is properly imprinted in the printing station 3.

The width of the band 6 is further measured in the region of the inlet 29 of the printing station 4 by means of the measuring device 30, 31. The control unit 15 compares the magnitude of the width 7 at the inlet 29 with the magnitude of the width 7 at the inlet 9. If the magnitudes are identical, the band 6 travels into the printing station 4 unchanged. However, if the magnitude of the width 7 at the inlet 29 exceeds the magnitude of the width 7 at the inlet 9, the control unit 15 generates a control signal which depends on the difference between the magnitudes. The control signal regulates the rotational speed of the fan 34 via the motor 35 as well as the amount of heat generated by the heating device which is used to heat the air drawn through the drying chamber 33 by the fan 34. The heated air is conveyed through the chamber 33 and contacts the band 6 in the process. This causes moisture to be removed from the band 6 so that the latter contracts. The rotational speed of the fan 34 and the heat generated by the air heating device are regulated in such a manner that the amount of moisture removed from the band 6 is that required to return the magnitude of the width 7 at the inlet 29 to the magnitude of the width 7 at the inlet 9. By returning the dimensions of the band 6 at the inlet 29 to the dimensions which it possesses at the inlet 9, the contour 26 is brought into precise alignment with the printing device in the printing station 4.

When the band 6 exits the printing station 4 via the outlet 27 thereof, the band 6 carries the image 28. The image 28 includes regions which originally constituted part of the contours 16 and/or 26 as well as regions which were newly formed in the printing station 4. The band 6 with the image 28 is wound onto the takeup roller 5.

Figure 3:
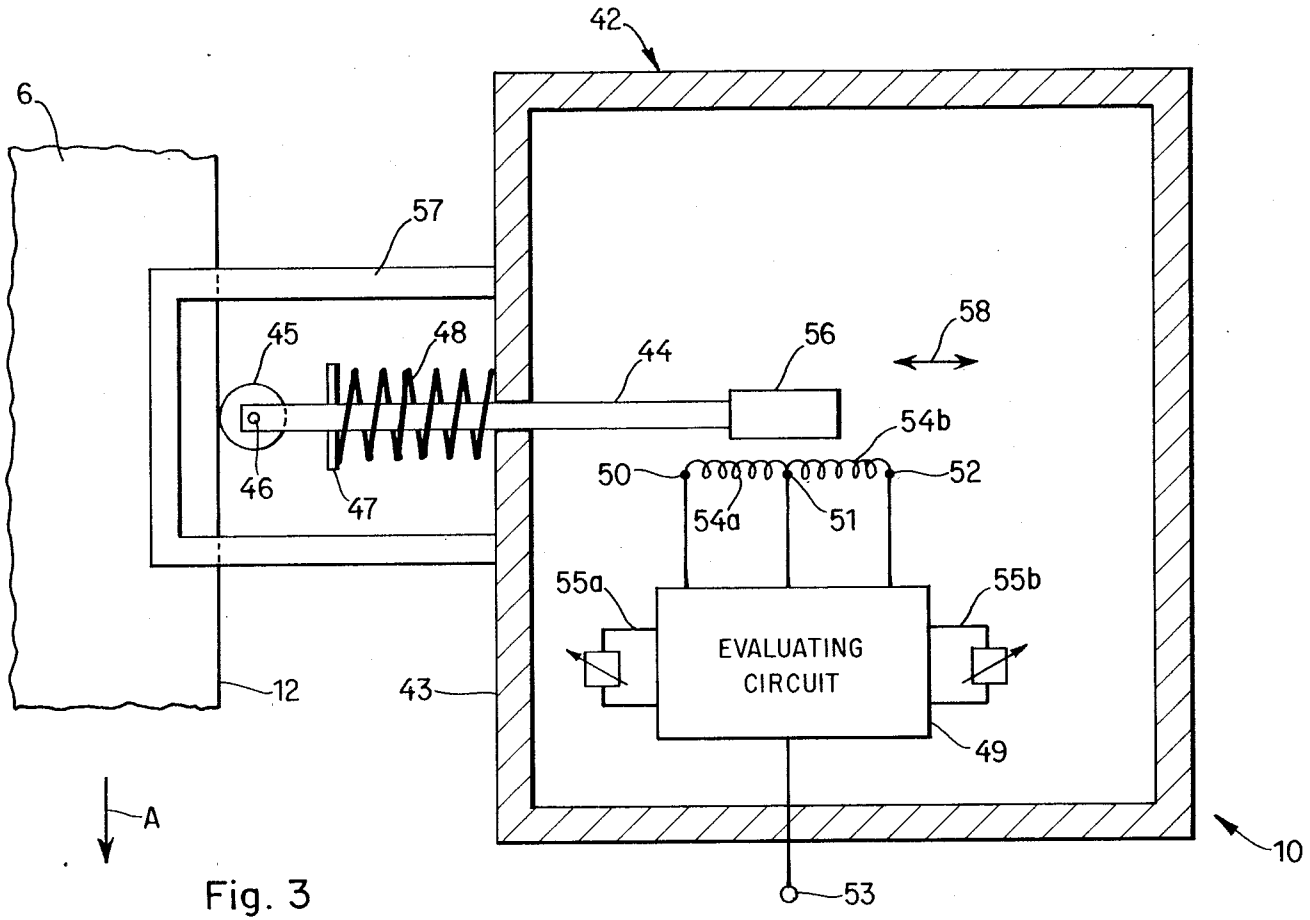
FIG. 3 is a sectional plan view of an edge sensing unit for the printing arrangement of FIGS. 1 and 2.

FIG. 3 illustrates details of the detecting unit 10. Since the detecting units 11, 18, 19, 30, 31 are identical to the detecting unit 10, only the latter will be described.

The detecting unit 10 includes a housing 42 having a wall 43 which confronts the band 6. The wall 43 is provided with an opening, and a plunger 44 is mounted in the opening for back-and-forth movement as indicated by the double-headed arrow 58. One end of the plunger 44 is located outside of the housing 42 in the region of the edge 12 of the band 6 while the opposite end of the plunger 44 is located inside the housing 42.

The outside end of the plunger 44 carries a roller 45, and the latter is rotatably mounted on the outside end of the plunger 44 through the agency of a vertical shaft 46 which is journalled in such end. The roller 44 is arranged to contact the edge 12 of the band 6. The plunger 44 is provided with a collar 47 intermediate the roller 45 and the wall 43 of the housing 42, and a spring 48 is mounted on the plunger 44 in the region between the collar 47 and the wall 43. The spring 48 acts on the collar 47 and reacts against the wall 43 to thereby bias the roller 45 towards the edge 12 of the band 6.

Inside the housing 42 is an evaluating circuit 49. The evaluating circuit 49 has three input terminals 50, 51, 52 as well as an output terminal 53. A first induction coil 54*a* is connected between the input terminals 50, 51 while a second induction coil 54*b* is connected between the input terminals 51, 52. The induction coils 54*a*, 54*b* may have the same number of windings or different numbers of windings. Similarly, the number of windings per unit length of the coil 54*a* may be the same as or different from that of the coil 54*b*. The induction coils 54*a*, 54*b* are disposed horizontally, and the axes of the induction coils 54*a*, 54*b* are perpendicular to the direction of advance A of the band 6. The evaluating circuit 49 is provided with variable devices 55*a*, 55*b* which respectively function to adjust the electrical characteristics of the induction coils 54*a*, 54*b*.

The end of the plunger 44 inside the housing 42 carries an elongated magnetic core 56. The core 56 is disposed horizontally and confronts the induction coils 54*a*, 54*b*. The axis of the core 56 is perpendicular to the direction of advance A of the band 6, and hence parallels the axes of the coils 54*a*, 54*b*.

The induced voltages in the coils 54*a*, 54*b* depend upon the position of the core 56 which, in turn, depends upon the width of the band 6. As the width of the band 6 increases, the edge 12 of the band 6 will shift the roller 45, plunger 44 and core 56 to the right as viewed in FIG. 3. When the width of the band 6 decreases, the spring 48 will urge the plunger 44, roller 45 and core 56 to the left as seen in FIG. 3. These movements of the core 56 change the induced voltage in the core 54*a* as well as that in the core 54*b* thereby changing the ratio of the voltages. The evaluating circuit 49 converts the relative voltage value into an output voltage or current representative of the position of the core 56.

A pair of U-shaped elements 57 made of sheet material is mounted on the wall 43 of the housing 42. The elements 57 are disposed one above the other so that only one is visible in FIG. 3. Each of the elements 57 is located in a horizontal plane and is arranged in such a manner that the closed end thereof overlaps the band 6. One of the elements 57 lie above while the other lies below the band 6, and the elements 57 cooperate with one another to define a narrow guide slot for the band 6. The elements 57 further cooperate with the wall 43 of the housing 42 to define an enclosure, and the roller 45 as well as the portion of the plunger 44 located outside of the housing 42 are received in such enclosure.

Figure 4:
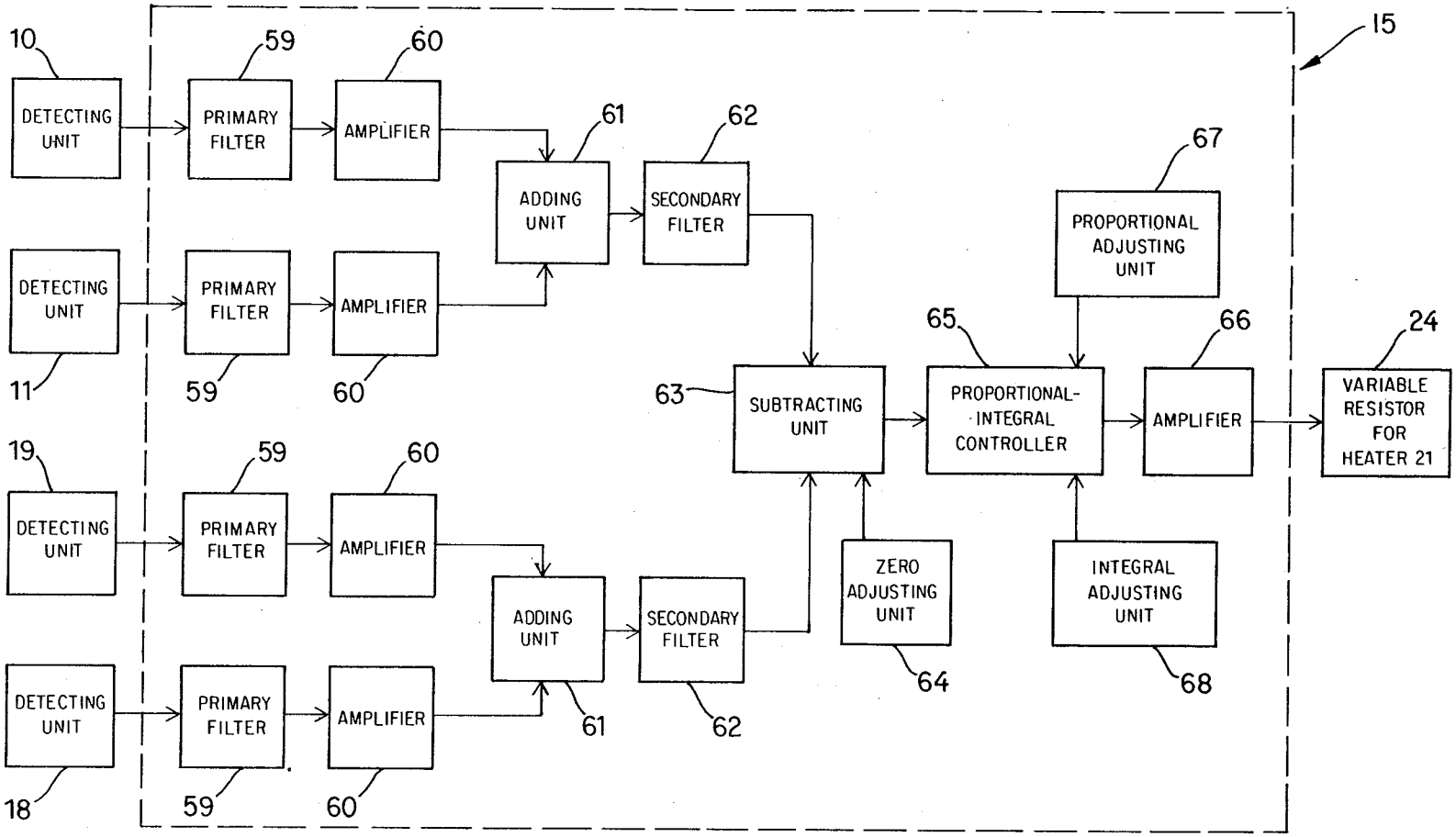
FIG. 4 is a block diagram of a control unit constituting part of the printing arrangement of FIGS. 1 and 2.

FIG. 4 illustrates the manner in which the control unit 15 regulates the heating device 21 as a function of the difference in width of the band 6 at the measuring device 10, 11 and the measuring device 18, 19.

The output 53 of each detecting unit 10, 11 18, 19 is connected with a respective primary filter 59 which smoothes the output signal of the associated detecting unit 10, 11, 18, 19. The smoothed signal issuing from a primary filter 59 is delivered to a respective amplifier 60.

The signals from the two amplifiers 60 of the detecting units 10, 11 are sent to an adding unit 61 which sums the signals. Similarly, the signals from the two amplifiers 60 of the detecting units 18, 19 are summed in a second adding unit 61. Each of the adding units 61 is connected with a respective secondary filter 62 which serves to smooth the output signal of the corresponding adding unit 61.

The signals from the two secondary filters 62 are delivered to a subtracting unit 63 which subtracts the sum of the signals generated by the detecting units 10, 11 from the sum of the signals generated by the detecting units 18, 19. The resultant signal issued by the subtracting unit 63 is representative of the difference in width of the band 6 at the measuring device 10, 11 and the measuring device 18, 19. The subtracting unit 63 is connected with an adjusting unit 64 which serves for zero adjustment of the subtracting unit 63.

The output of the subtracting unit 63 is connected with a PI controller 65, that is, a controller containing a circuit having a proportional branch and an integral branch which are arranged in parallel. The signal issued by the controller 65 is sent to an amplifier 66 which, in turn, is connected with the variable resistor 24 for the heating device 21. The resistor 24 regulates the output of the heating device 21 in dependence upon the magnitude of the signal arriving from the controller 65.

When the band 6 is imprinted in the printing station 2, the band 6 absorbs moisture from the printing ink or dye, and this moisture causes an increase in the width of the band 6. The signal from the controller 65 is representative of this increase and adjusts the output of the heating device 21 in such a way that the band 6 is heated to the extent necessary to drive out the absorbed moisture. The band 6 will then return to its original width, that is, the width as measured by the measuring device 10, 11.

The integral or I branch of the controller 65 functions to insure continuous adustment of the band 6 to the width as measured by the measuring device 10, 11. The proportional or P branch, on the other hand, provides for a high control speed.

The required output of the heating device 21 depends upon the ambient humidity; the material of the band 6; the speed of advance of the band 6; and the magnitude of the change in width of the band 6. In order to correct the signal from the controller 65, and hence the output of the heating device 21, for variations in these parameters, the controller 65 is connected with two adjusting units 67, 68. The adjusting unit 67 serves to adjust the amplification or gain of the P branch of the controller 65 while the adjusting unit 68 serves to adjust the amplification or gain of the I branch. For a particular type of band material and a particular type of heating device 21, the amplification factors required for different combinations of ambient humidity and band speed in the humidity and speed ranges of interest are determined empirically. The amplification factors are then tabulated as a function of ambient humidity and band speed.

The control unit 15 is here illustrated as being an analog unit with manually operable adjusting units 67, 68. For this control unit 15, the tables of amplification factors are written out so that the factors for a given set of conditions can be read by an operator who then sets the adjusting units 67, 68 accordingly. However, the control unit 15 may also be in the form of a digital unit. In such an event, the control unit 15 may include a keyboard as well as a memory. For each combination of heating device 21 and band material, the memory then stores a table of amplification factors as a function of ambient humidity and band speed. The particulars of the band material, heating device 21, ambient humidity and band speed are entered in the control unit 15 by an operator via the keyboard. The control unit 15 reads the corresponding pair of amplification factors from the appropriate table and automatically sets the proportional adjusting unit 67 and the integral adjusting unit 68 to the required values.

For a digital control unit 15, an analog/digital converter will be interposed between each of the detecting units 10, 11, 18, 19 and the respective primary filter 59. Similarly, a digital/analog converter will be interposed between the controller 65 and the amplifier 66.

Instead of a PI controller, the controller 65 may be in the form of a PID controller, that is, a controller having a proportional branch, an integral branch and a differential branch which are arranged in parallel.

The control unit 15 includes a second circuit similar to that of FIG. 4 for determining the difference in the width of the band 6 at the measuring device 10, 11 and the measuring device 30, 31. This second circuit differs from that of FIG. 4 in that the controller 65 of the second circuit is connected both to the variable resistor 41 which regulates the fan 34 and to the air heating device for the drying chamber 33. A signal of given magnitude issued by the controller 65 of the second circuit thus results in a specific combination of fan speed and drying air temperature.

The required combination of fan speed and drying air temperature depends upon the ambient humidity; the material of the band 6; the speed of advance of the band 6; and the magnitude of the difference in width of the band 6 at the measuring device 10, 11 and the measuring device 30, 31. The signal from the controller 65 of the second circuit, and hence the speed of the fan 34 and the output of the air heating device for the drying chamber 33, is again corrected for variations in the listed parameters by adjusting units 67, 68 serving to adjust the amplifications or gains of the P and I branches of the controller 65. For a particular type of band material and a particular combination of fan and heating device, the amplification factors required for different combinations of ambient humidity and band speed in the humidity and speed ranges of interest are determined empirically. The amplification factors are then tabulated as a function of ambient humidity and band speed. If the control unit 15 is an analog unit with manually operable adjusting units 67, 68, the tables of amplification factors are written out so that the amplification factors for a given set of conditions can be read by an operator who then sets the adjusting units 67, 68 accordingly. On the other hand, if the control unit 15 is a digital unit, such tables may be stored in a memory of the control unit 15 as described previously.

The illustrated embodiment of the printing arrangement includes two different types of devices for removing moisture from the band 6. One of these is the heating device 21 which directly contacts and heats the band 6 in order to drive off moisture therefrom. The other is the drying apparatus 33, 34 where moisture is removed from the band 6 by contacting the latter with a gas. While both types of devices are shown for illustrative purposes. the printing arrangement of the invention is advantageously provided with only one type of device for removing moisture from the band 6. It is currently preferred to remove moisture from the band 6 by means of heated air.

In the preceding description, the dimensions of the band 6 are adjusted by driving off controlled amounts of moisture from the band 6. However, other methods of adjusting the dimensions of the band 6 may be used. For example, the dimensions of the band 6 may be adjusted by regulating the stress which acts upon the band 6 or by regulating the elasticity of the band 6. Furthermore, although the preceding description assumes that the dimensions of the band 6 increase so that adjustment of the dimensions involves a contraction of the band 6, it will be understood that the adjustment may involve an expansion of the band 6 in the event that the dimensions thereof decrease.

The width 7 of the band 6 may be measured in any number which permits control signals to be generated. Furthermore, another physical characteristic or parameter of the band 6 which is representative of the degree of deformation of the band 6 may be used to establish the deformation undergone by the band 6.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptions should and are intended to be comprehended without the meaning and range of equivalence of the appended claims.

We claim:

1. A printing method, comprising the steps of conveying an image carrier along a predetermined path which extends through a first printing station, and a second printing station located downstream of said first station, said carrier having a pair of edges which are spaced transversely of said path; measuring the width of said carrier upstream of said first station by sensing both edges; imprinting a predetermined region of said carrier in said first station; remeasuring the width of said carrier between said first and second stations by sensing both edges; comparing the widths obtained during the measuring and remeasuring steps; adjusting said carrier when the widths obtained from the measuring and remeasuring steps differ significantly from one another, comprising substantially equalizing the widths obtained during the measuring and remeasuring steps; and imprinting said region in said second station.

2. The method of claim 1, wherein said region is imprinted with a different color in each of said stations.

3. The method of claim 1, the remeasuring step being performed immediately upstream of said second station employing adjustable measuring means; and wherein said measuring means is adjusted at least approximately to the width as measured upstream of said first station.

4. The method of claim 3, wherein the measuring step is performed immediately upstream of said first station employing additional adjustable measuring means adjusted at least approximately to the width upstream of said first station.

5. The method of claim 1, wherein the adjusting step comprises regulating deformation of said carrier.

6. The method of claim 1, wherein the adjusting step comprises regulating the elasticity of said carrier.

7. The method of claim 1, wherein the adjusting step comprises regulating the stress applied to said carrier.

8. The method of claim 1, wherein the adjusting step comprises regulating deformation of said carrier via the moisture content of the latter.

9. The method of claim 8, wherein the adjusting step comprises removing moisture from said carrier.

10. The method of claim 9, wherein the adjusting step comprises heating said carrier.

11. The method of claim 9, wherein the adjusting step comprises exposing said carrier to an air stream.

12. The method of claim 11, wherein said air stream is heated.

13. A printing arrangement, comprising conveying means for conveying an image carrier along a predetermined path, the carrier having a pair of edges which are spaced transversely of said path; a first printing station in a first portion of said path; first measuring means upstream of said first station for measuring the width of the carrier by sensing both edges thereof; a second printing station in a second portion of said path downstream of said first portion; second measuring means between said first and second stations for remeasuring the width of the carrier by sensing both edges thereof; and adjusting means for the carrier connected with said first and second measuring means, said adjusting means being designed to compare the widths obtained from said first and second measuring means, and to substantially equalize the widths at said first and second measuring means.

14. The arrangement of claim 13, wherein said first printing station comprises printing means for imprinting the carrier with a first color and said second printing station comprises printing means for imprinting the carrier with a different second color.

15. The arrangement of claim 13, wherein said adjusting means comprises heating means for heating the carrier.

16. The arrangement of claim 13, wherein said adjusting means comprises contacting means for contacting the carrier with an air stream.

17. The arrangement of claim 16, wherein said adjusting means comprises regulating means for regulating the air stream.

18. The arrangement of claim 17, wherein said regulating means is designed to regulate the quantity of air delivered to said contacting means.

19. The arrangement of claim 17, wherein said regulating means is designed to regulate the velocity of the air stream.

20. The arrangement of claim 16, wherein said contacting means comprises a chamber for removing moisture from the carrier.

21. The arrangement of claim 20, wherein said adjusting means comprises heating means for heating the air stream.

22. The arrangement of claim 21, wherein said adjusting means comprises regulating means for said heating means.

23. The arrangement of claim 22, wherein said regulating means is designed to regulate the air stream.

24. The arrangement of claim 13, wherein said second measuring means is disposed immediately upstream of said second station, said second measuring means being adjustable so as to permit at least approximate adjustment of said second measuring means to the width of the carrier.

25. The arrangement of claim 24, wherein said first measuring means is arranged immediately uupstream of said first station, said first measuring means being adjustable so as to permit at least approximate adjustment of the same to the width of the carrier.

* * * * *